United States Patent [19]

Kubo

[11] Patent Number: 4,727,615

[45] Date of Patent: Mar. 1, 1988

[54] BOWLING LANE MAINTENANCE APPARATUS

[75] Inventor: Chikanari Kubo, Sagamihara, Japan

[73] Assignee: Eishin Technology Company, Limited, Japan

[21] Appl. No.: 873,956

[22] Filed: Jun. 13, 1986

[51] Int. Cl.[4] ..... A47L 13/30; B24B 29/00

[52] U.S. Cl. ..... 15/98; 15/51; 118/108

[58] Field of Search ..... 15/49 R, 49 C, 50 R, 15/50 A, 50 C, 51, 340, 98; 118/108, 109, 111

[56] References Cited

U.S. PATENT DOCUMENTS

| | | | |
|---|---|---|---|
| 3,150,407 | 9/1964 | Mitchell | 15/98 X |
| 3,217,347 | 11/1965 | Domecki | 15/51 |
| 3,418,672 | 12/1968 | Regan | 15/98 |
| 3,785,001 | 1/1974 | Niemi et al. | 118/108 X |
| 3,868,738 | 3/1975 | Horst et al. | 15/98 X |
| 4,134,361 | 1/1979 | Benjamin | 15/98 X |
| 4,463,469 | 8/1984 | Green | 15/98 |

FOREIGN PATENT DOCUMENTS

| | | | |
|---|---|---|---|
| 937006 | 1/1973 | Canada | 15/98 |
| 2302109 | 1/1973 | Fed. Rep. of Germany | 15/98 |

*Primary Examiner*—Donald Watkins

*Attorney, Agent, or Firm*—Andrus, Sceales, Starke & Sawall

[57] ABSTRACT

The present invention provides a bowling lane maintenance apparatus of applying a conditioning oil to the surface of a bowling lane and then buff finishing the oil applied bowling lane surface, said maintenance apparatus including a body, a box member pivotally mounted on said body and including a pair of parallel spaced side plates, oil applicator and buffing rollers rotatably supported within said box member perpendicular to said side plates and disposed on the opposite sides about the pivot, and a positioning air cylinder mechanism operably interposed between said body and one edge of said box member at its longitudinal center, said positioning air cylinder mechanism being adapted to pivot said box member such that one of said oil applicator and buffing rollers will be brought into contact with the surface of the bowling lane or both the rollers will be separated from the bowling lane surface.

1 Claim, 3 Drawing Figures

BOWLING LANE MAINTENANCE APPARATUS

BACKGROUND OF THE INVENTION

1. Field of the Invention

The present invention relates to a bowling lane maintenance apparatus comprising applicator roller means for applying a conditioning oil to the surface of a bowling lane and buffing roller means for polishing the oil applied surface of the bowling lane, and more particularly to a roller selecting mechanism for use in such a bowling lane maintenance apparatus, which can selectively be actuated to bring one of the applicator and buffing rollers into contact with the bowling lane surface.

2. Description of the Prior Art

Frequent cleaning and maintenance are required in bowling lanes to maintain the bowling lane surfaces at a good ball throwing condition and to condition them into an equal characteristics, the latter being particularly requested in conpetitions. Maintenance is accomplished by applying the conditioning oil to the bowling lanes in a very thin and uniform layer or in layers having desirably variable thickness by the use of the applicator roller means and then polishing the oil applied bowling lanes with the buffing roller means. Thus, the maintenance apparatus is designed such that the applicator roller means will first be brought into contact with the surface of a bowling lane from the foul line toward the pin zone in that bowling lane and then the buffing roller means will be placed into contact with the bowling lane surface from the pin zone toward the foul line.

In the prior art, the maintenance apparatus comprises a roller selecting mechanism by which each of the applicator and buffing rollers is forced into contact with the bowling lane. It is therefore difficult to contact the roller with the bowling lane under a uniform pressure throughout the length of the roller. As a result, the conditioning oil can hardly be applied to the bowling lane with a uniform or desirably variable thickness.

SUMMARY OF THE INVENTION

It is therefore an object of the present invention to overcome the above problem in the prior art and to provide a bowling maintenance apparatus comprising a roller selecting mechanism which can resiliently support the applicator and buffing rollers such that each of the rollers will be in contact with the surface of the bowling lane under a uniform and fixed pressure throughout the contact area therebetween and which can selectively bring one of these rollers into contact with the bowling lane or both the rollers into discontact with the bowling lane.

To accomplish the above object, the present invention provides a bowling lane maintenance apparatus of applying a conditioning oil to the surface of a bowling lane and then buff finishing the oil applied bowling lane surface, said maintenance apparatus comprising a body, a box member pivotally mounted on said body and including a pair of parallel spaced side plates, oil applicator and buffing roller means rotatably supported within said box member perpendicular to said side plates and disposed on the opposite sides about the pivot, and a positioning air cylinder mechanism operably interposed between said body and one edge of said box member at its longitudinal center, said positioning air cylinder mechanism being adapted to pivot said box member such that one of said oil applicator and buffing roller means will be brought into contact with the surface of the bowling lane or both the roller means will be separated from the bowling lane surface.

DESCRIPTION OF PREFERRED EMBODIMENT

Figure 2:
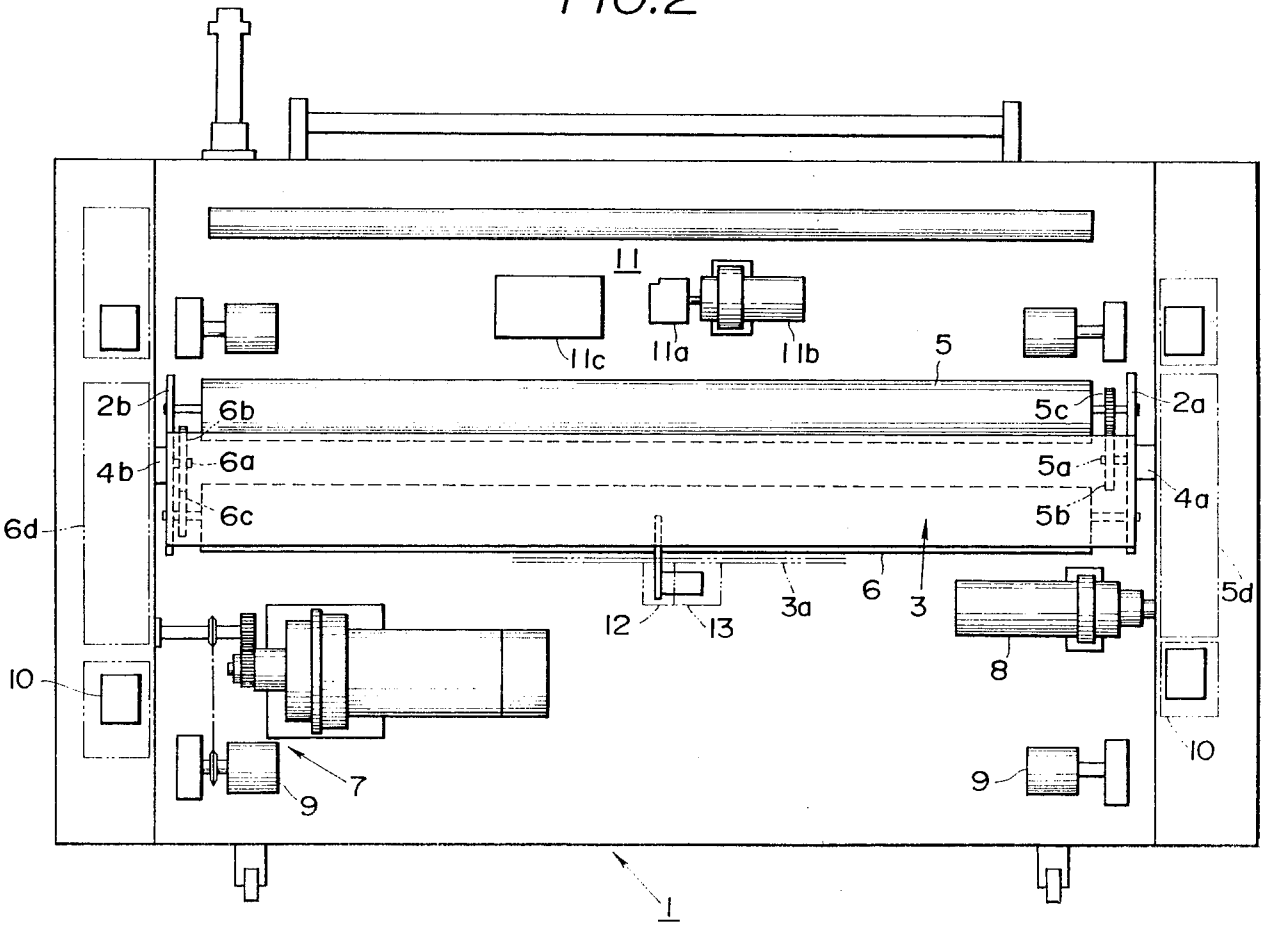
FIG. 2 is a schematic plan view showing the entire arrangement of the bowling lane maintenance apparatus utilizing the roller selecting mechanism shown in FIGS. 1A and 1B.

Referring now to FIG. 2, there is shown a bowling lane maintenance apparatus comprising a body 1 on which a box member 3 is pivotally mounted through shafts 4*a* and 4*b*. The box member 3 includes a pair of parallel spaced side plates 2*a* and 2*b* which are disposed parallel to the length of a bowling lane. The side plates 2*a* and 2*b* rotatably support oil applicator and buffing rollers 5 and 6 which extend perpendicular to these side plates. The oil applicator roller 5 is disposed forwardly of the body 1 about the shafts 4*a* and 4*b* while the buffing roller 6 is arranged rearwardly of the body 1 about the shafts 4*a* and 4*b*.

Rotating shafts 5*a* and 6*a* respectively extend through the shafts 4*a* and 4*b* supporting the side plates 2*a* and 2*b*. Gear wheels 5*b* and 6*b* are respectively mounted on the inner ends of the rotating shafts 5*a* and 6*a*. Each of the gear wheels 5*b* or 6*b* is operably engaged by the respective one of gear wheels 5*c* and 6*c* which are respectively mounted rigidly on the rotating shafts of the oil applicator and buffing rollers 5 and 6. Thus, the rotating shafts 5*a* and 6*a* can rotatingly be driven respectively by drive mechanism 7 and drive motor 8 through power transmission mechanisms 5*d* and 6*d*, respectively.

The bowling lane maintenance apparatus is such designed that the oil applicator roller 5 is first brought into contact with the surface of the bowling lane at a position near the foul line thereon and then rotated by the actuation of the drive motor 8. The body 1 is moved forwardly in front of the pin zone of the bowling lane when longitudinally driving wheels 9 are forwardly rotated by the drive mechanism 7. Thus, the conditioning oil can be applied to the bowling lane in a very thin layer. Subsequently, the oil applicator roller 5 is separated from the bowling lane surface while the buffing roller 6 is brought into contact with the lane surface and rotated by the drive mechansim 7. At the same time, the longitudinally driving wheels 9 are reversely rotated by the drive mechanism 7 to move the body 1 back to the foul line for buff finishing. The body 1 may automatically and sequentially carry out the maintenance for a plurality of bowling lanes. To this end, the body 1 is provided with a traversing mechanism 10 which functions to raise the buffing roller 6 on completion of the maintenance for one bowling lane and at the same time to hold the oil applicator roller at its raised position. The traversing mechanism 10 then operates to move the body 1 to the adjacent bowling lane for the same maintenance.

The positioning of these rollers is accomplished by positioning the box member 3 at its oil applying, buffing or neutral position under the control of a roller selecting mechanism which comprises a source of compressed air 11 consisting of an air compressor 11*a*, a drive motor 11*b* and an air accumulator 11*c* and two air cylinders 12 and 13.

Figure 1B:
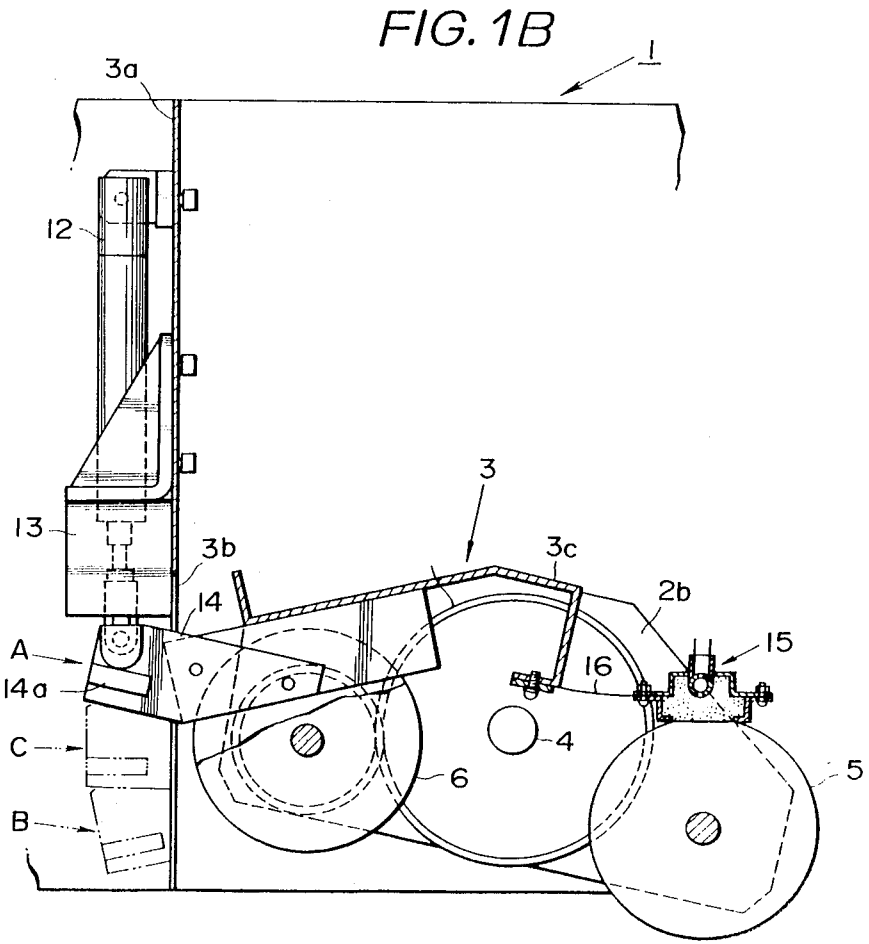
FIG. 1B is a fragmentary side view, partially broken away and in section, of the bowling lane maintenance apparatus shown in FIG. 1A.
Figure 1A:
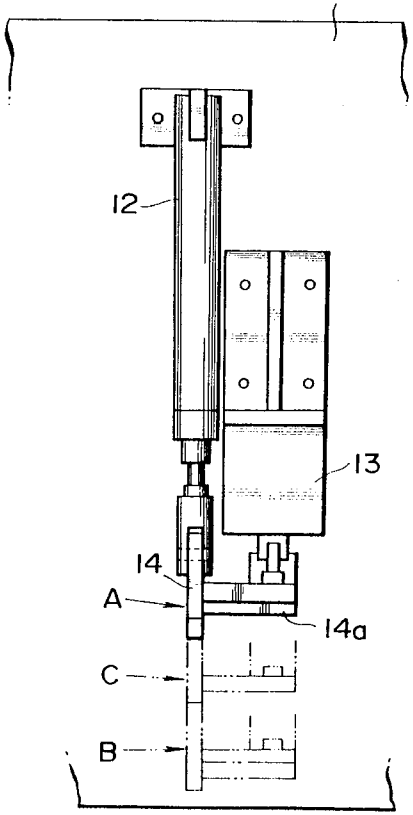
FIG. 1A is a fragmentary elevational view of a bowling lane maintenance apparatus according to the present invention, showing one form of a roller selecting mechanism used in such a maintenance apparatus.

As be best seen from FIGS. 1A and 1B, the box member 3 includes a longitudinally extending rearward partition 3*a* including an opening 3*b* through which an arm member 14 extends. The arm member 14 is rigidly mounted at one end on an upper plate 3*c* of the box member 3 at its longitudinal center.

On the side of the partition 3*a* opposite to the box member 3 are mounted an air cylinder 12 having a longer stroke and another air cylinder 13 having a shorter stroke but a larger biasing force. The air cylinder 12 is pivotally connected at one end with the partition 3*a* and has its piston rod end pivotally connected with the distal end of the arm member 14 extending through the opening 3*b* of the partition 3*a*. The arm member 14 includes a horizontally extending lug 14*a* which is adapted to engage the piston rod end of the air cylinder 13. The air cylinders 12 and 13 different in stroke and biasing force from each other define a positioning air cylinder mechanism for positioning the arm member 14 of the box member at one of the oil applying position A, buffing position B and neutral position C therebetween, as will be apparent.

A conditioning oil supply unit 15 is disposed on the oil applicator roller 5 and has its bottom face being always pressed against the top of the oil applicator roller 5 with a fixed pressure under the action of a leaf spring 16 which is fixedly mounted on the upper plate 3*c* of the box member 3.

On operation, the box member 3 is positioned at its oil applying position A when the maintenanse body 1 is placed at its start position. This is accomplished by shifting the piston rod end of the air cylinders 12 and 13 to their uppermost levels under the actuation of the compressed air source 11. Since the piston rod end of the air cylinder 13 is separated from the horizontal lug 14*a* of the arm member 14, the box member 3 is rotated clockwise as viewed in FIG. 1B about the shafts 4*a* and 4*b* to the oil applying position A under the bias of the air cylinder 12. Thus, the oil applicator roller 5 is brought into contact with the surface of a bowling lane. The biasing force of the air cylinder 12 is preselected to be equal to the reaction in the oil applying roller 5 and also the arm member 14 is provided on the box member 3 at its longitudinal center. Therefore, the oil applying roller 5 can be held in contact with the lane surface under a uniform and fixed pressure throughout the contact area therebetween. This is true for a bowling lane having a more or less irregularity since the air cylinder 12 provides an air cushion.

When it is subsequently to buff finish the oil applied surface of the bowling lane, the air cylinder 12 is energized by compressed air from the source 11 such that the piston rod end will be placed at its lowermost position. The box member 3 is thus rotated counter-clockwise as viewed in FIG. 1B about the shafts 4*a* and 4*b* to the buffing position B to bring the buffing roller 6 into contact with the lane surface. The biasing force of the air cylinder 12 is preselected to determine the reaction in the buffing roller 6 and also the arm member 14 is rigidly mounted on the box member 3 at its longitudinal center. Therefore, the buffing roller 6 can be contacted by the lane surface under a uniform and fixed pressure throughout the contact area therebetween. This is true for a bowling lane having a more or less irregularity since the air cylinder 12 provides an air cushion.

On completion of the maintenance including the oil applying and buffing operations, the maintenance apparatus may be moved transversely to the adjacent bowling lane by the actuation of the traversing mechanism 10. At this time, the air cylinders 12 and 13 are shifted to their uppermost and lowermost positions, respectively. Since the biasing force of the air cylinder 13 is preselected to be larger than that of the air cylinder 12, the position of the arm member 14 is determined by the air cylinder 13 to hold the box member 3 at its neutral position C in which both the rollers 5 and 6 are separated from the bowling lane surface. The maintenance operation is then repeated for the adjacent bowling lane.

As will be apparent from the foregoing, the bowling lane maintenance apparatus of the present invention comprises a box member including a pair of parallel spaced side plates and being pivotally supported by the maintenance apparatus body, oil applying and buffing rollers extending perpendicular to the side plates and disposed on the opposite sides about the pivot axis of the box member, and a positioning air cylinder mechanism for shifting the box member to the desired position, said mechanism being disposed between the edge of the box member at its longitudinal center and the apparatus body, the arrangement being such that one of the oil applicator and buffing rollers is selectively brought into contact with the surface of the bowling lane or both the rollers is separated from the bowling lane surface. Thus, the conditioning oil can be applied to the surface of the bowling lane in a more uniform layer or in layers having desirably variable thickness, independently of the contact pressure between the operating roller and the bowling lane surface.

It is to be understood that many modifications may be made for the illustrated embodiment of the present invention without departing the scope of the invention. For example, the oil applicator and buffing rollers may detachably be mounted on the box member.

I claim:

1. A bowling lane maintenance apparatus for applying a conditioning oil to the surface of a bowling lane and then buff finishing the oil applied bowling lane surface, said maintenance apparatus comprising: a body, a box member pivotally mounted on said body and including a pair of parallel spaced side plates, oil applicator and buffing roller means rotatably supported within said box member perpendicular to said side plates and disposed on the opposite sides about the pivot, and a positioning air cylinder mechanism operably interposed between said body and one edge of said box member at its longitudinal center, said positioning air cylinder mechanism being adapted to pivot said box member such that one of said oil applicator and buffing roller means will be brought into contact with the surface of the bowling lane or both the roller means will be separated from the bowling lane surface, said positioning air cylinder mechanism including two air cylinders different in stroke and biasing force from each other, one of said air cylinders having a longer stroke and a smaller biasing force being pivotally connected with said box member, the other air cylinder having a shorter stroke and a larger biasing force engaging said box member, whereby said box member can be shifted to its desired position by the action of said one air cylinder, the pressure exerted on the oil applying roller means through said box member can be controlled by the action of said other air cylinder, and said box member can be held by said other air cylinder at a netural position wherein both the roller means are separated from the bowling lane.

* * * * *